US006493895B1

(12) United States Patent
Reynolds

(10) Patent No.: US 6,493,895 B1
(45) Date of Patent: Dec. 17, 2002

(54) TRUSS ENHANCED BRIDGE GIRDER

(76) Inventor: Zachary M. Reynolds, 29 W. El Rose Dr., Petaluma, CA (US) 94952

( * ) Notice: Subject to any disclaimer, the term of this patent is extended or adjusted under 35 U.S.C. 154(b) by 0 days.

(21) Appl. No.: 09/673,290

(22) PCT Filed: Feb. 18, 2000

(86) PCT No.: PCT/US00/04347

§ 371 (c)(1),
(2), (4) Date: Oct. 12, 2000

(87) PCT Pub. No.: WO00/49230

PCT Pub. Date: Aug. 24, 2000

Related U.S. Application Data

(60) Provisional application No. 60/120,994, filed on Feb. 19, 1999.

(51) Int. Cl.[7] ..... E01D 6/00; E01D 11/00; E01D 2/00

(52) U.S. Cl. ..... 14/4; 14/3; 14/13; 14/74.5

(58) Field of Search ..... 14/3, 4, 13, 74.5; 52/633, 647, 650.1, 691

(56) References Cited

U.S. PATENT DOCUMENTS

| | | | | |
|---|---|---|---|---|
| 309,289 | A | | 12/1884 | Blackman et al. |
| 530,265 | A | | 12/1894 | Fenn |
| 1,181,013 | A | | 4/1916 | Inglis |
| 2,333,136 | A | | 11/1943 | Wolfard ..... 189/37 |
| 4,489,659 | A | | 12/1984 | Kamohara et al. ..... 104/124 |
| 4,642,830 | A | | 2/1987 | Richard ..... 14/4 |
| 5,305,572 | A | * | 4/1994 | Yee ..... 264/228 |
| 5,651,154 | A | * | 7/1997 | Ahlskog et al. ..... 14/6 |
| 5,695,141 | A | | 12/1997 | Sekimoto ..... 242/260 |
| 5,810,507 | A | * | 9/1998 | Ahlskog et al. ..... 404/53 |

FOREIGN PATENT DOCUMENTS

| | | | |
|---|---|---|---|
| JP | 4-216776 | * | 8/1992 |
| JP | 8-3923 | * | 1/1996 |

* cited by examiner

*Primary Examiner*—Gary S. Hartmann
(74) *Attorney, Agent, or Firm*—Gray Cary Ware & Freidenrich

(57) ABSTRACT

A truss for distributing a maximum bending moment normally occurring at a midpoint region of a girder (430) includes a first truss segment member (505) having first and second ends, a second truss segment member (420) having first and second ends, a third truss segment member (510) having first and second ends, a fourth truss segment member (425) having first and second ends, and a fifth truss segment member (415) having first and second ends. The first end of the first truss segment member (505) is attached substantially perpendicular to the girder at a first location near the midpoint region of the girder and the second end of the second truss segment member (420) is attached to the second end of the first truss segment member (505). The first end of the third truss segment member (510) is attached substantially perpendicular to the girder (430) at a second location near the midpoint region of the girder. The first location is located between the second location and the first end of the girder. The first end of the fourth truss segment member (425) is attached at the midpoint region of the girder (430) and the second end of the fourth truss segment member (425) is attached to the second end of the third truss segment member (510). The first end of the fifth truss segment member (415) is attached to the second end of the first truss segment member (505) and the second end of the fifth truss segment member is attached to the second end of the third truss segment member (510). An upward force is applied to the second ends of the first and third truss segment members (505, 510) to distribute the maximum bending moment of the girder (430) toward the ends of the girder.

19 Claims, 16 Drawing Sheets

TRUSS ENHANCED BRIDGE GIRDER

This application claims the benefit of Provisional application Ser. No. 60/120,994, filed Feb. 19, 1999.

TECHNICAL FIELD OF THE INVENTION

The present invention relates generally to bridges. In particular, this invention relates to a truss for redistributing and reducing the bending moment of a girder, and furthermore, reducing the deflection of the girder.

BACKGROUND OF THE INVENTION

Bridge design has developed into three basic categories in an effort to decrease the size and cost of the bridge and its supporting "bridgeworks" for long bridge spans. The three basic categories are trussed spans and arches, suspension spans, and beam, box and T girders. Trussed span and arches are generally used for supporting two types of structures, bridges and roof frames. The different types of bridge trusses include Warren bridge trusses, Howe bridge trusses, and Pratt bridge trusses. The different types of roof frame trusses include Belgian trusses, Fink trusses, Howe trusses, Pratt trusses, Crecent trusses, Fan trusses, and Scissor trusses. These conventional trussed span and arch designs employ pin-jointed lattice frameworks composed of tension and compression members. The different trussed span frameworks, although complex, obtain their strength from the simple geometric rigidity of the triangle. These conventional trussed span framework designs are composed of straight tension and compression members which extend the length of the bridge span as a uniform assembly of chords resolving loads and moments at each framework joint. Since the rigidity of the trussed span and arch framework is secured by triangles which cannot deform without changing the length of the sides, it is generally assumed that loads applied at the panel points or joint will only produce direct stress. Thus, trusses with large vertical height or depth can be designed to resist vertical loads more efficiently using trussed span and arches than beam, box or T girders.

Due to the complexity of the trussed span and arch frame work, trussed span and arches are used in bridge design only when long spans are required. The Warren bridge truss is generally thought to be the most economical of the trussed span and arch designs. A typical Warren bridge truss 100 is shown in FIG. 1. The Warren bridge truss 100 is comprised of a top chord 105, a bottom chord 110, vertical web members 115, and diagonal web members 120. Web members 115 and 120 form the basic triangular geometry 125 common to all trussed span and arch bridge designs. The joint 130 rigidity of each triangular section resists the load applied to the bottom chord 110 of the Warren bridge truss 100. In conventional applications, the depth of the Warren bridge truss 100 to the length of the bridge span is usually between 1:5 and 1:10. Thus, for a bridge span of 60 feet, the height of the top chord 105 of the Warren bridge truss 100 structure above the bottom chord 110 is from 6 to 12 feet. When a load is applied to a bottom chord 110 between the joints 130, the bottom chord 110 does not directly interact with the primary truss diagonal and vertical lacing of the Warren bridge truss 100. Instead, the load is distributed by beam action of the bottom chord 110 to the adjacent joints 130.

Roof trusses are generally different from bridge trusses because roofs are often pitched, meaning that the top chord of the truss is set at an angle to the horizontal. Roof trusses are designed to support loads which are applied to the top chord of the roof and to accommodate the functionality of the roof as a surface which drains or sheds water, snow or other fluid loads. The bottom chord of the roof truss is considered to be axially loaded, not subjected to beam action where the member bends. A typical Belgian roof truss 200 is shown in FIG. 2. This shows the top chord 205 pitched to the horizontal, a horizontal bottom chord 210, parallel vertical members 215 and diagonal members 220. The parallel vertical members 215 and the diagonal members 220 comprise the web members of the Belgian roof truss 200.

A typical variation of the Belgian roof truss 200 is shown in FIG. 3 where it is used as a bridge truss. This variation shown in FIG. 3 eliminates all diagonal members 220, and may eliminate all vertical members 215 shown in FIG. 2, except the vertical member 315 at the bridge midpoint 320. The variation shown in FIG. 3 offers support to the bottom chord 310 by creating an upwards reaction in member 315 due to the compressive loads in the diagonal members 305. This upwards reaction at member 315 modifies the downwards load which the bottom chord 310 experiences, and consequentially modifies the strain and stress of the beam action in the bottom chord 310. According to trussed framed theory, the load applied to the bottom chord 310 between joints 325 is distributed to the joints 325 by beam action for the beam length between the bottom chord 310 end points and midpoint 320. However, using the theory of work, strain energy in the bottom chord 310 is modified by the reaction at the joint 325 located at the bottom chord 310 midpoint 320 and the length of the beam between end points 330 and 335.

The second type of bridge design is a suspension span. Suspension spans utilize cable networks suspended from arches or towers to connect to and support a bridge roadway. The suspension cables serve as multiple support points for the roadway span and effectively reduce the size of the overall bridge structure. The arch or towers serve as the main support for the bridge span. The roadway can either be a beam girder or trussed structure.

The third type of bridge design is a beam, box and T girder. Beam, box and T girder bridge spans involve a structural shape, or combination of shapes, which has a section modulus and moment of inertia that supports the design load between the unsupported length of the span. Beam girder bridges rely upon the bending of the beam, or "beam action" to support the bridge load. When a beam is subjected to a load, it bends in the plane of the load. This bending action creates fields of stresses which resist the bending and create an equilibrium condition. For example, a simple beam supported at each end which bends down under a load is experiencing a shortening of the top (or concave surface), and a lengthening of the bottom (or convex surface). These changes in the beam's shape create horizontal tensile and compressive stresses at the beam's surfaces. In order for these beam's two surfaces to work together, vertical shear is developed in the beam web, which is the section located between the top and bottom of the beam. The internal moment developed in the beam section by the horizontal and vertical stresses, generally called "beam action", resists the external bending moment of the applied load. The external bending moment calculated by summing the moments of the external forces acting at either end of the beam.

Beam girders for bridge spans are preferred over trussed span and arches or suspension spans because of their simplicity. A compact beam girder is an efficient system which transfers shear and load between the extreme upper and lower elements, in most cases flanges, of the beam. This is especially true for a rolled beam section, such as an I beam. The compact beam section of an I beam functions as a complete system requiring little or no modification in order to support its calculated load. However, for a beam, box or T girder design having a uniformly applied load per foot, the bending moment increases by the square of the span. This can cause very large increases in girder beam size with relatively small increases in span. Thus, when designing a bridge using a beam, box or T girder, the structural requirements of the girder are determined by merely adjusting the size of the girder to fit the design constraints (stress or deflection) until the size of the girder becomes so large and expensive that a shift to the more complex trussed span and arch or suspended bridge designs becomes practicable.

In the large majority of cases, bridge girder size is also determined by deflection criteria rather than limitations on beam stress. Deflection criteria are usually expressed as an allowable vertical deflection per foot of bridge span. For example, a 1:350 deflection criterion would require that a bridge girder not deflect more than 1 foot for every 350 feet under a design load. Deflection criteria from 1:800 up to 1:1200 are common in both vehicular and pedestrian bridge girder designs. Hence deflection limitations often dominate bridge girder design, defeating the economy of higher-strength steels which allow greater stress levels than the same cross-section of mild steels. There is no conventional truss design that utilizes a compact truss system which compares to the simple cross section of a beam girder. Each truss system design requires multiple connections, lacings and chords, which complicate and increase construction and erection costs.

SUMMARY OF THE INVENTION

The present invention provides a truss for enhancing a girder that substantially eliminates or reduces disadvantages and problems associated with previously developed girder enhancing trusses.

More specifically, the present invention provides a truss for distributing a maximum bending moment normally occurring at a midpoint region of a girder having first and second ends and a uniform applied load. The truss for distributing a maximum bending moment normally occurring at a midpoint region of a girder includes a first truss segment member having first and second ends, a second truss segment member having first and second ends, a third truss segment member having first and second ends, a fourth truss segment member having first and second ends, and a fifth truss segment member having first and second ends. The first end of the first truss segment member is attached substantially perpendicular to the girder at a first location near the midpoint region of the girder. The first end of the second truss segment member is attached at the midpoint region of the girder and the second end of the second truss segment member is attached to the second end of the first truss segment member. The first end of the third truss segment member is attached substantially perpendicular to the girder at a second location near the midpoint region of the girder. The first location is located between the second location and the first end of the girder. The first end of the fourth truss segment member is attached at the midpoint region of the girder and the second end of the fourth truss segment member is attached to the second end of the third truss segment member. The first end of the fifth truss segment member is attached to the second end of the first truss segment member and the second end of the fifth truss segment member is attached to the second end of the third truss segment member. An upward force is applied to the second ends of the first and third truss segment members to distribute the maximum bending moment of the girder toward the ends of the girder. A first positive maximum bending moment of the girder occurs between the first end of the girder and the first location and a second positive maximum bending moment of the girder occurs between a second end of the girder and the second location.

The present invention provides an important technical advantage by providing a truss design that reduces the required size and material weight of a bridge girder for any given span by a factor of three or more over conventional bridge girder designs.

The present invention provides another important technical advantage by providing a truss design that reduces the deflection at the midpoint of a girder by a factor of four or more over conventional bridge girder designs.

The present invention provides yet another important technical advantage by providing a truss design that significantly reduces bridge girder design costs for any given span.

The present invention provides yet another important technical advantage by providing a truss which embodies a capacity for increased weight at the midpoint of the bridge girder design so road expansions, rest areas, turn-arounds, or parking areas can be constructed at the girder midpoint.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the Figures., like numerals being used to refer to like and corresponding parts of the various drawings.

Beam girders for bridge spans are typically preferred over trussed span and arches or suspension spans because of their simplicity. However, for beam girder bridges designed for a uniformly applied load per foot of bridge span, the bending moment increases by the square of the bridge span. This can cause very large increases in girder beam size with relatively small increases in bridge span. A primary objective of this invention is to provide a way to significantly reduce the required size of a bridge beam girder for any given bridge span. One way to accomplish this task is by placing a truss segment within the span of the girder to act as a mechanism where actuation is predicated upon movement and angular deflection of the girder, thus reducing the maximum bending moment and deflection at a midpoint region of the girder.

Figure 1:
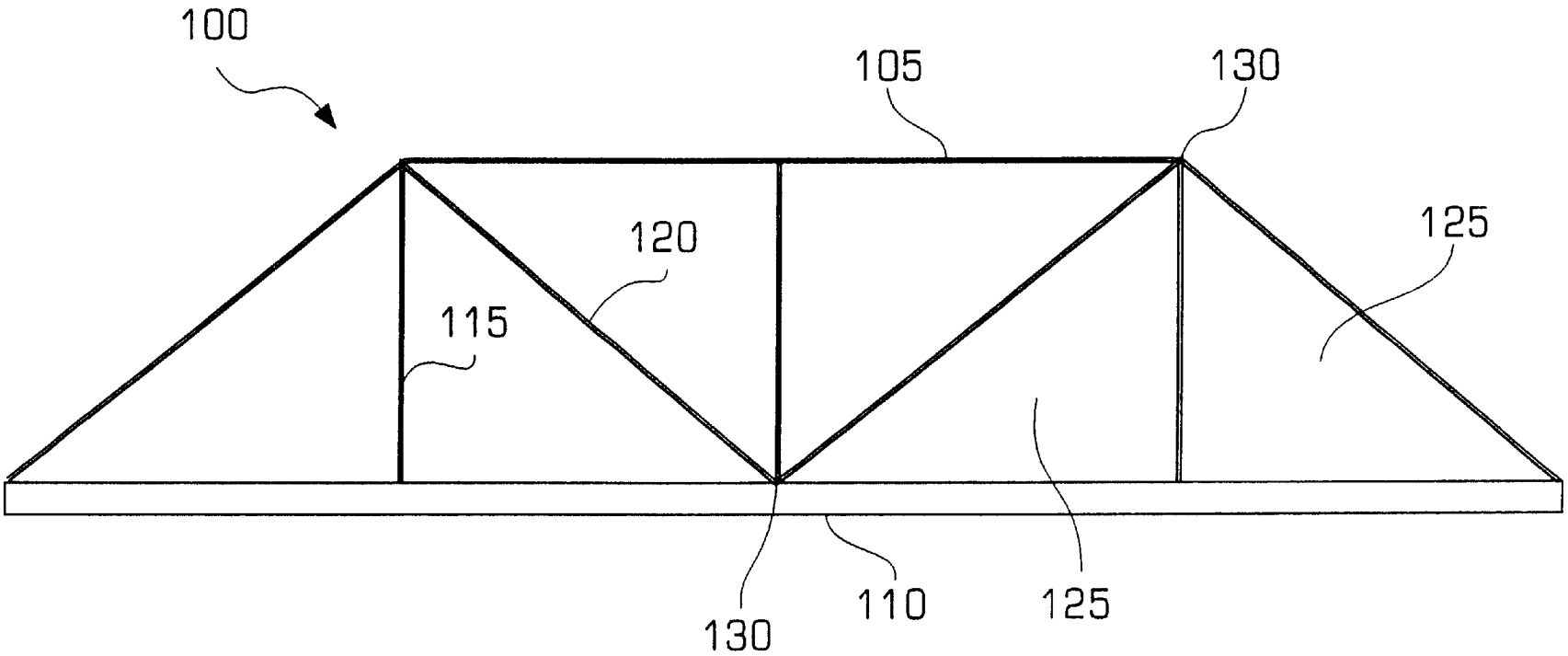
FIGURE 1 (PRIOR ART)
FIG. 1 shows a prior art drawing of a typical Warren bridge truss.
Figure 2:
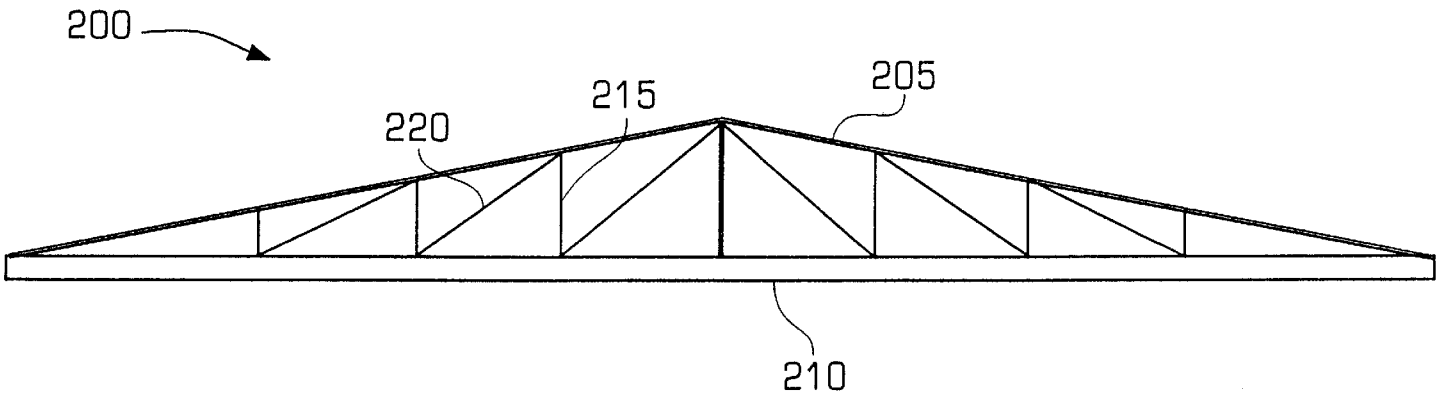
FIGURE 2 PRIOR ART
FIG. 2 shows a prior art drawing of a typical Belgian roof truss.
Figure 3:
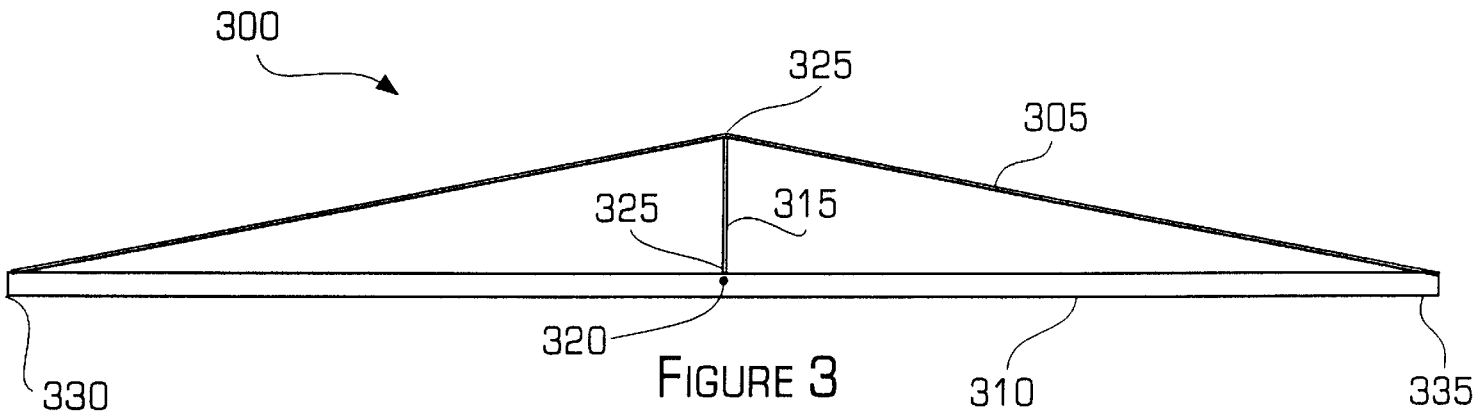
FIGURE 3 PRIOR ART
FIG. 3 shows a prior art drawing of a variation of the Belgian roof truss which is used as a bridge truss.
Figure 4:
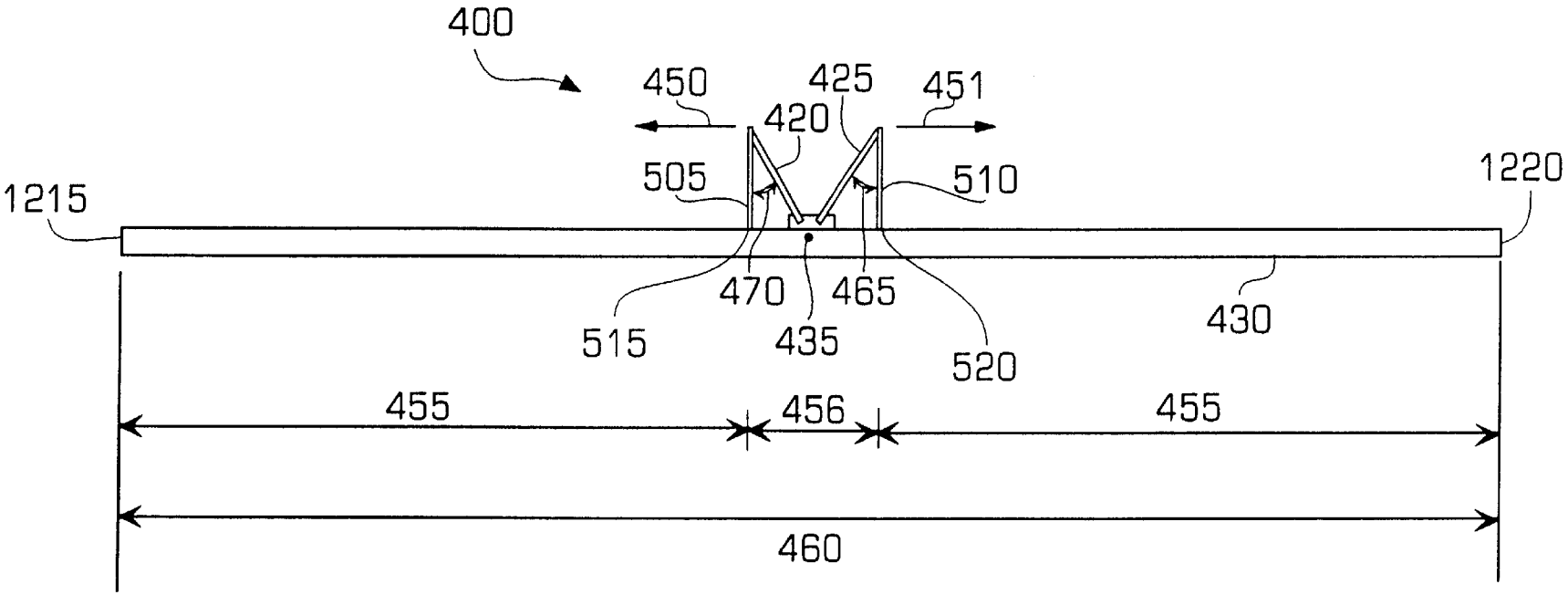
FIG. 4 shows one embodiment of a truss segment.

FIG. 4 shows one embodiment of a truss segment 400 for distributing a maximum bending moment normally occurring at a midpoint 435 region of a girder 430 having a uniformly applied load according to the present invention. The truss segment 400 includes a first truss segment member 505 having first and second ends, a second truss segment member 420 having first and second ends, a third truss segment member 510 having first and second ends, and a fourth truss segment member 425 having first and second ends. The first end of the first truss segment member 505 is attached substantially perpendicular to the girder 430 at a first location 515 near the midpoint 435 region of the girder 430. The first end of the second truss segment member 420 is attached at the midpoint 435 region of the girder 430 and the second end of the second truss segment member 420 is attached to the second end of the first truss segment member 505. The first end of the third truss segment member 510 is attached substantially perpendicular to the girder 430 at a second location 520 near the midpoint 435 region of the girder 430. The first location 515 is located between the second location 520 and the first end 1215 of the girder 430. The first end of the fourth truss segment member 425 is attached at the midpoint 435 region of the girder 430 and the second end of the fourth truss segment member 425 is attached to the second end of the third truss segment member 510. An outward lateral force 450 toward the first end 1215 of the girder 430 is applied to the second end of the first truss segment member 505 and an outward lateral force 451 toward the second end 1220 of the girder 430 is applied to the second end of the third truss segment member 510 to distribute the maximum bending moment of the girder 430.

As shown in FIG. 4, the first truss segment member 505 and the third truss segment member 510 of the truss segment 400 are approximately equidistant from the midpoint 435 of the girder 430. The width 456 between the first location 515 of the first truss segment member 505 and the second location 520 of the third truss segment member 510 is of the order of less than or equal to one-third (⅓) the length 460 of the girder. Furthermore, the ratio of the length of the first and third truss segment members, 505 and 510 respectively, to the length 460 of the girder 430 are of the order of 1:11 to 1:17. This means that for a 60 foot long girder 430, the length of the first and third truss segment members, 505 and 510 respectively, can be as high as 5.5 feet above the girder 430, but not less than 3.75 feet above the girder 430. This also means that the width 456 between the first and third truss segment members, 505 and 510, can be 20 feet or less. The angle 470 formed between the first truss segment member 420 and the second truss segment member 505 is approximately thirty-two degrees. Similarly, the angle 465 formed between the third truss segment member 510 and the fourth truss segment member 425 is approximately thirty-two degrees.

Figure 5:
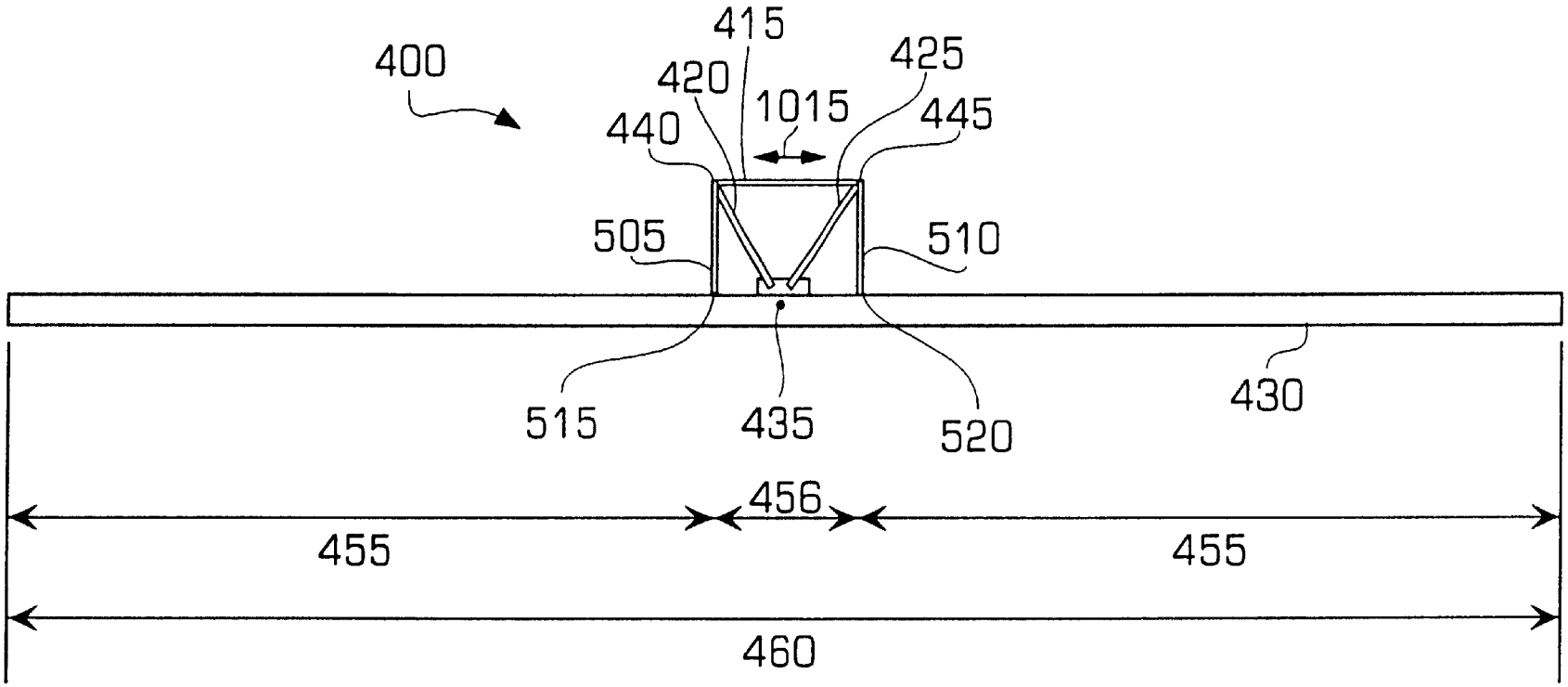
FIG. 5 shows another embodiment of the truss segment.

FIG. 5 shows an embodiment of the truss segment 400 which is exactly the same as the truss segment 400 of FIG. 4, with the addition of a fifth truss segment member 415. The first end of the fifth truss segment member 415 is connected to the second end of the first truss segment member 505 and the second end of the fifth truss segment member 415 is connected to the second end of the third truss segment member 510. The fifth truss segment member 415 replaces the outward lateral forces 450 and 451 with a compression force 1015 which pushes the second ends of the first and third truss segment members, 505 and 510 respectively, laterally outward toward the ends of the girder 430.

Figure 6:
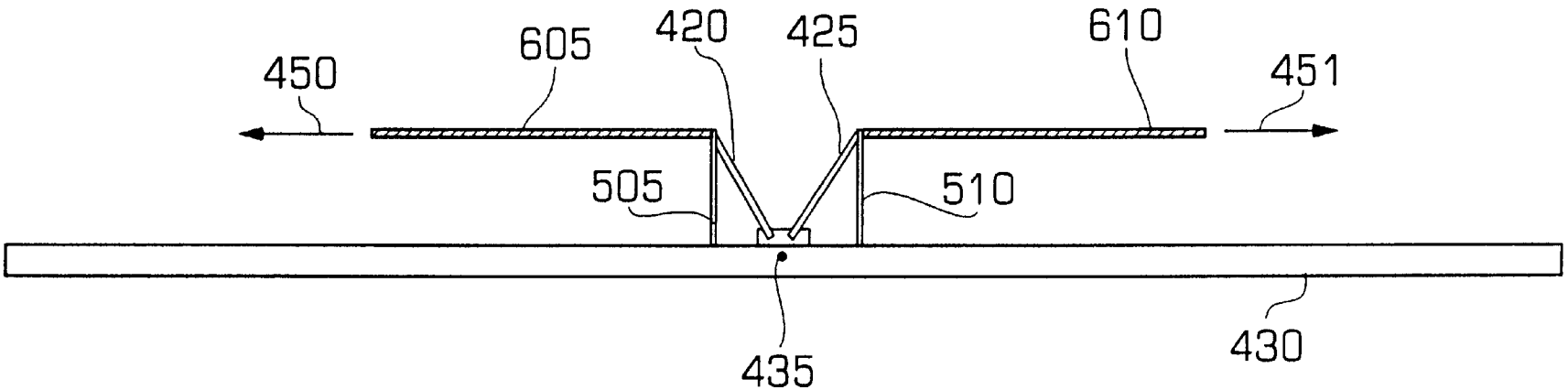
FIG. 6 shows yet another embodiment of the truss segment.

FIG. 6 shows an embodiment of the truss segment 400 which is exactly the same as the truss segment 400 of FIG. 4, with the addition of a first cable 605 and a second cable 610. The first cable 605 is attached to the second end of the first truss segment member 505 and the second cable 610 is attached to the second end of the third truss segment member 510. A mechanism for tensioning the first and second cables, 605 and 610 respectively, can be applied to the first and second cables 605 and 610 respectively, to provide the outward lateral forces 450 and 451 toward the ends of the girder 430.

Figure 7:
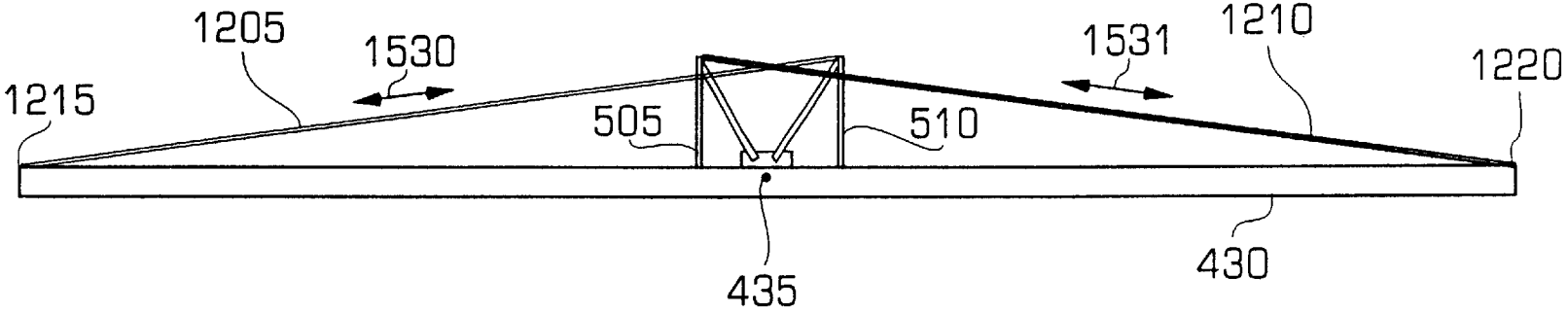
FIG. 7 shows yet another embodiment of the truss segment.

FIG. 7 shows an embodiment of the truss segment 400 which is exactly the same as the truss segment 400 of FIG. 4, with the addition of a first diagonal truss member 1205 having first and second ends and a second diagonal truss member 1210 having first and second ends. The first end of the first diagonal truss member 1205 is attached to the second end of the third truss segment member 510 and the second end of the first diagonal truss member 1205 is attached substantially close to the first end 1215 of the girder 430. The first end of the second diagonal truss member 1210 is attached to the second end of the first truss segment member 505 and the second end of the second diagonal truss member 1210 is attached substantially close to the second end 1220 of the girder 430. The first diagonal truss member 1205 replaces the outward lateral force 451 with a compression force 1530 which pushes the second end of the third truss segment member 510 laterally outward toward the second end 1220 of the girder 430. The second diagonal truss member 1210 replaces the outward lateral force 450 with a compression force 1531 which pushes the second end of the first truss segment member 505 laterally outward toward the first end 1215 of the girder 430.

Figure 8:
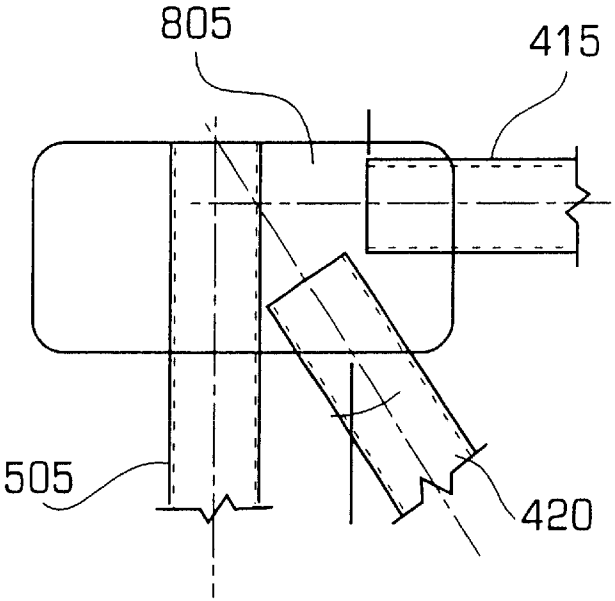
FIG. 8 shows one embodiment of a first truss segment connector.
Figure 9:
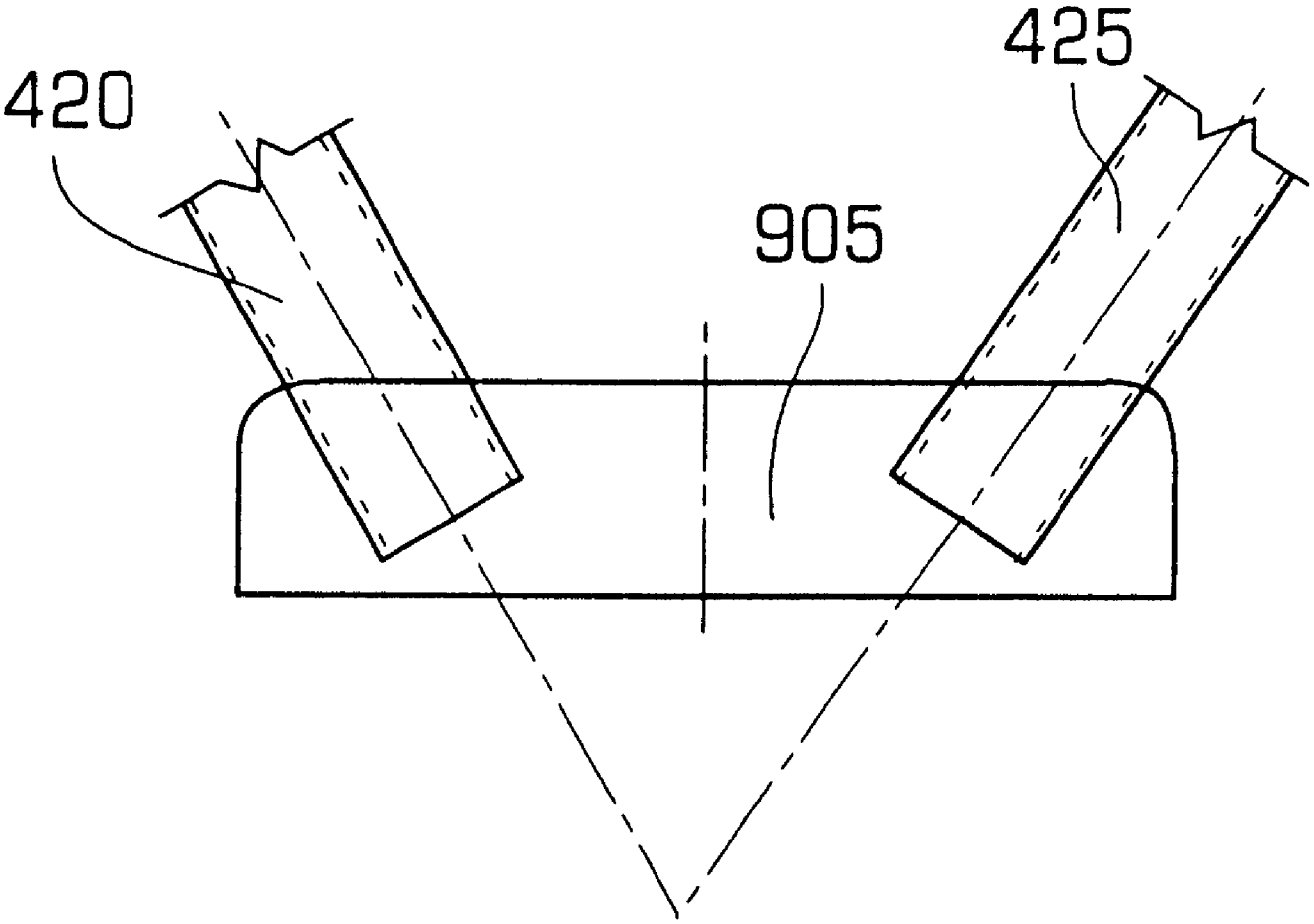
FIG. 9 shows a one embodiment of a second truss segment connector.

FIG. 8 shows one embodiment of a connector 805 which connects the fifth truss segment member 415, the second truss segment member 420, and the first truss segment member 505 together. Note that in this embodiment of connector 805, none of the truss segment members 415, 420, or 505 touch each other, thus reducing secondary end moments of the truss segment members 415, 420, and 505 within the connector 805. A connector 806 which is substantially identical to connector 805 connects the fifth truss segment member 415, the fourth truss segment member 425, and the third truss segment member 510 together. FIG. 9 shows one embodiment of a connector 905 which connects the second truss segment member 420 and the fourth truss segment member 425 together. Note that in this embodiment of connector 905, neither of the truss segment members 420 or 425 touch each other, thus reducing secondary end moments of the truss segment members 420 and 425 within the connector 905.

Figure 10:
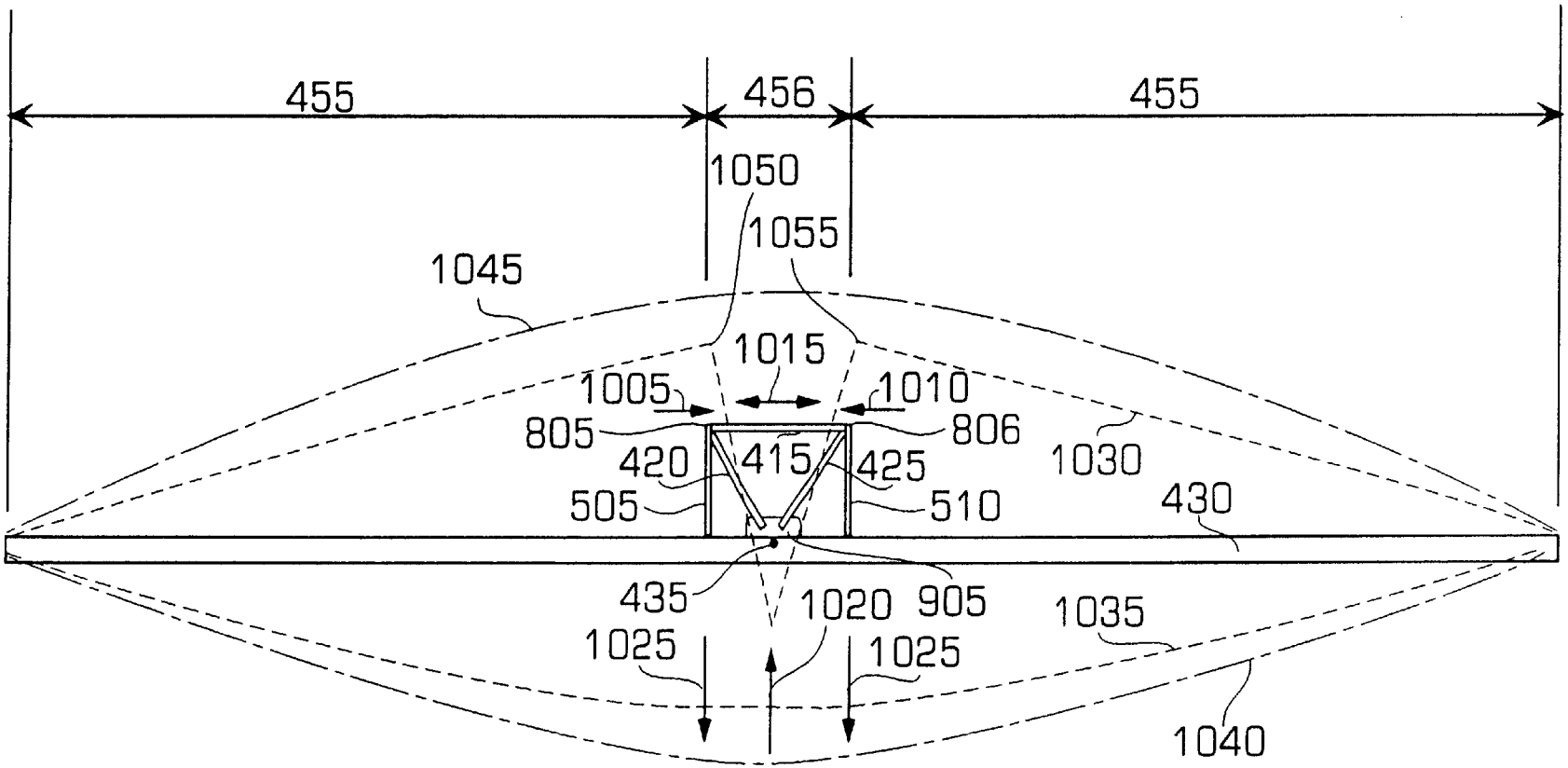
FIG. 10 illustrates how one embodiment of the compact truss segment redistributes the maximum bending moment and reduces the deflection of the girder.

FIG. 10 illustrates how the preferred embodiment of the truss segment 400 works together with the girder 430 to distribute and reduce the maximum bending moment of the girder 430 and reduce the deflection of the girder 430 when a uniform load is applied to the girder 430. As the girder 430 attempts to deflect down under the influence of an applied load, it also rotates away from the horizontal. As a result of this rotation, the second ends of the first and third truss segment members, 505 and 510 respectively, tend to move towards each other as shown by force vectors 1005 and 1010. The fifth truss segment member 415 prevents the movement of the first and third truss segment members, 505 and 510 respectively, thus placing the fifth truss segment member 415 in compression as shown by force vector 1015. As a consequence, the triangles formed by the first and second truss segment members, 505 and 420 respectively, and the third and fourth truss segment members, 510 and 425 respectively, exert a prying force upon the girder 430 which opposes the normal bending of the girder 430 as the girder 430 experiences "beam action". This prying force tends to lift 1020 the girder 430 at a region near the midpoint 435, and push down 1025 on the girder 430 at the first and second locations, 515 and 520 respectively, where the first and third truss segment members, 505 and 510 respectively, are located. As a result of the prying force, the bending moment 1045 which occurs when using conventional bridge girder designs is distributed along the girder 430. The distributed bending moment 1030 is shown in FIG. 10.

A first positive maximum 1050 of the distributed bending moment 1030 occurs substantially at the first location 515 of the first truss segment member 505 and a second positive maximum 1055 of the distributed bending moment 1030 occurs substantially at the second location 520 of the third truss segment member 510. The prying force created by the action of the truss segment 400 also tends to flatten the girder deflection 1035 at a region near the midpoint 435 of the girder 430. The prying force thus effectively reduces the deflection 1040 which normally occurs in conventional bridge girder designs by 25% or more. A substantial economic advantage exists for any bridge configuration that reduces girder deflection without resorting to expensive deep girder designs or expensive conventional truss works.

Figure 11:
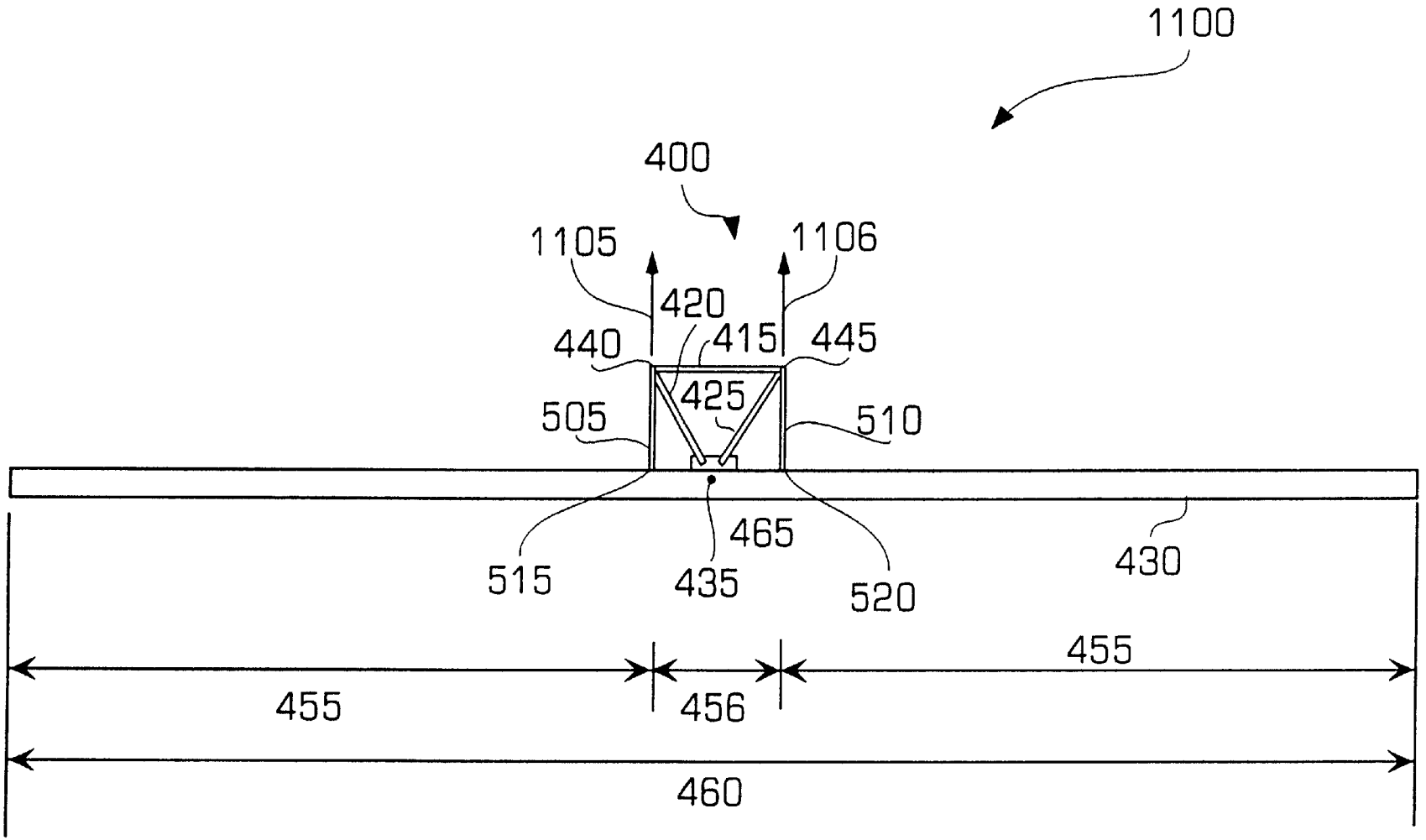
FIG. 11 shows one embodiment of the truss.

FIG. 11 shows one embodiment of a truss 1100 for distributing a maximum bending moment normally occurring at a midpoint 435 region of a girder 430 having a uniform applied load according to the present invention. The truss 1100 includes a first truss member 505 having first and second ends, a second truss segment 420 having first and second ends, a third truss segment 510 having first and second ends, a fourth truss segment 425 having first and second ends, and a fifth truss segment member 415 having first and second ends. The first end of the first truss segment member 505 is attached substantially perpendicular to the girder 430 at a first location 515 near the midpoint 435 region of the girder 430. The first end of the second truss segment member 420 is attached at the midpoint 435 region of the girder 430 and the second end of the second truss segment member 420 is attached to the second end of the first truss segment member 505. The first end of the third truss segment member 510 is attached substantially perpendicular to the girder 430 at a second location 520 near the midpoint 435 region of the girder 430. The first location 515 is located between the second location 520 and the first end 1215 of the girder 430. The first end of the fourth truss segment member 425 is attached at the midpoint 435 region of the girder 430 and the second end of the fourth truss segment member 425 is attached to the second end of the third truss segment member 510. The first end of the fifth truss segment member 415 is connected to the second end of the first truss segment member 505 and the second end of the fifth truss segment member 415 is connected to the second end of the third truss segment member 510. An upward force 1105 is applied to the second end of the first truss segment member 505 and an upward force 1106 is applied to the second end of the third truss segment members 510 to distribute the maximum bending moment of the girder 430 toward the ends of the girder 430.

The first truss segment member 505 and the third truss segment member 510 of the truss segment 400 shown here in FIG. 11 are approximately equidistant from the midpoint 435 of the girder 430. The width 456 between the first location 515 of the first truss segment member 505 and the second location 520 of the third truss segment member 510 is of the order of less than or equal to one-third (⅓) the length 460 of the girder. Furthermore, the ratio of the length of the first and third truss segment members, 505 and 510 respectively, to the length 460 of the girder 430 are of the order of 1:11 to 1:17. The angle 470 formed between the first truss segment member 420 and the second truss segment member 505 is approximately thirty-two degrees. Similarly, the angle 465 formed between the third truss segment member 510 and the fourth truss segment member 425 is approximately thirty-two degrees.

Figure 12:
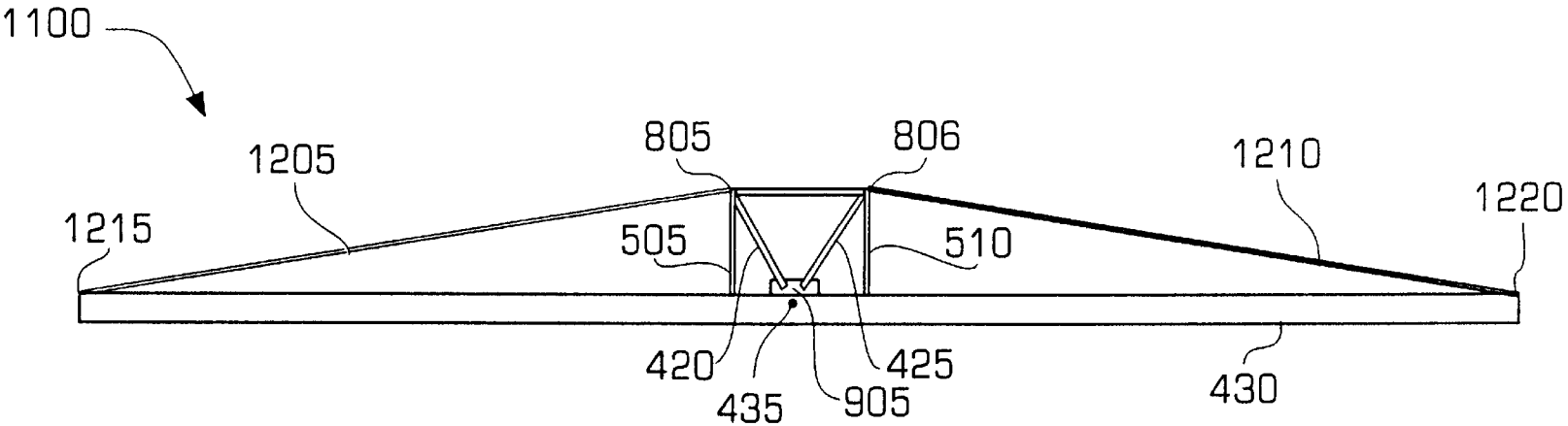
FIG. 12 shows another embodiment of the truss.

FIG. 12 shows a preferred embodiment of the truss 1100 which is exactly the same as the truss 1100 of FIG. 11, with the addition of the first diagonal truss member 1205 having first and second ends and the second diagonal truss member 1210 having first and second ends. The first end of the first diagonal truss member 1205 is attached to the second end of the first truss segment member 505 and the second end of the first diagonal truss member 1205 is attached substantially close to the first end 1215 of the girder 430. The first end of the second diagonal truss member 1210 is attached to the second end of the third truss segment member 510 and the second end of the second diagonal truss member 1210 is attached substantially close to the second end 1220 of the girder 430. The first diagonal truss member 1205 provides the upward force 1105 applied to the second end of the first truss segment member 505 and the second diagonal truss member 1210 provides the upward force 1106 applied to the second end of the third truss segment members 510 to distribute the maximum bending moment of the girder 430 toward the ends of the girder 430.

Figure 13:
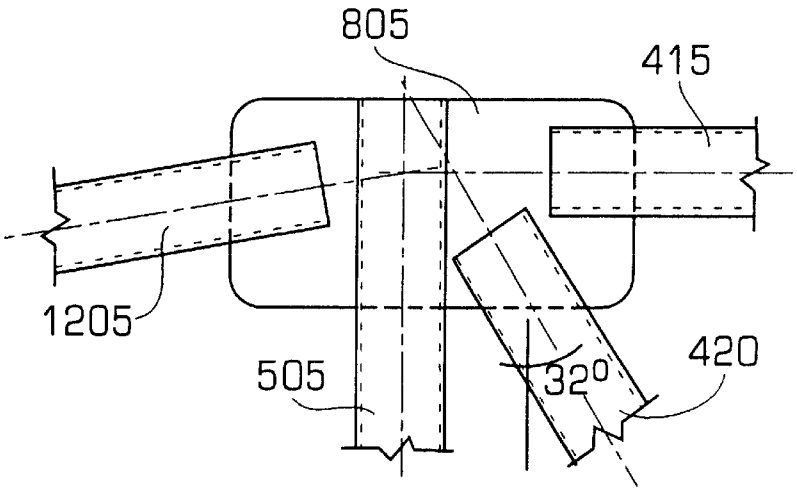
FIG. 13 shows another embodiment of the first truss segment connector.
Figure 14:
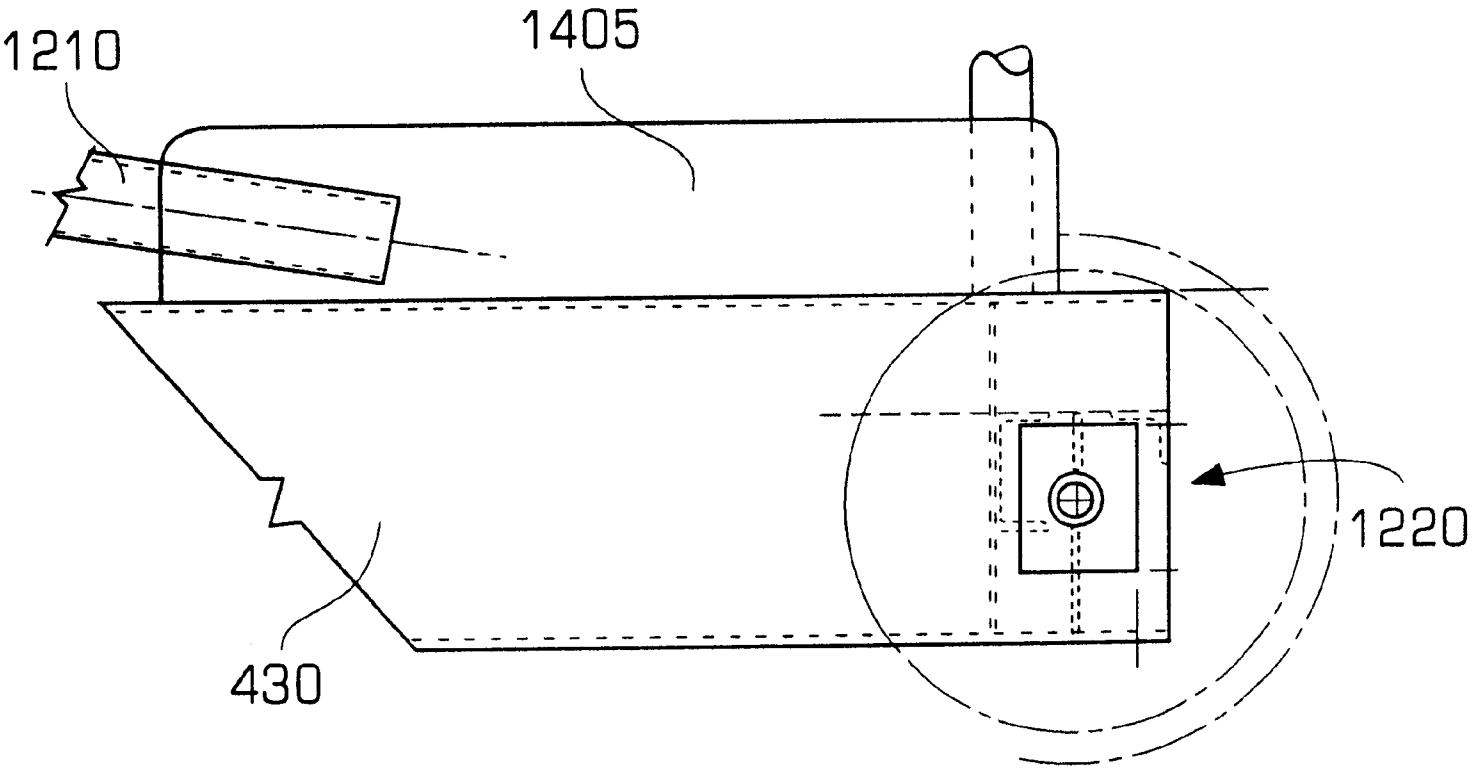
FIG. 14 shows an embodiment of a connector which connects the first and second diagonal truss members to the girder.

FIG. 13 shows another embodiment of the connector 805 which connects the fifth truss segment member 415, the second truss segment member 420, the first truss segment member 505, and the first diagonal truss member 1205 together. Note that in this embodiment of the connector 805, none of the truss segment members 415, 420, 505, or the diagonal member truss 1205 touch each other thus reducing secondary end moments of the truss segment members 415, 420, 505 and the diagonal truss member 1205 in the connector 805 in response to the uniform load applied to the girder 430. A connector 806 which is substantially identical to connector 805 connects the fifth truss segment member 415, the fourth truss segment member 425, the third truss segment member 510, and the second diagonal truss member 1210 together. FIG. 14 shows one embodiment of a connector 1405 which connects the second end of the second diagonal truss member 1210 and the girder 430 together. Note that in this embodiment of connector 1405, the second diagonal truss member 1210 and the girder 430 do not touch each other thus reducing secondary end moments of the diagonal member 1210 within the connector in response to the uniform load applied to the girder 430. A connector 1406 which is substantially identical to connector 1405 connects the second end of the first diagonal truss member 1205 and the girder 430 together.

Figure 15:
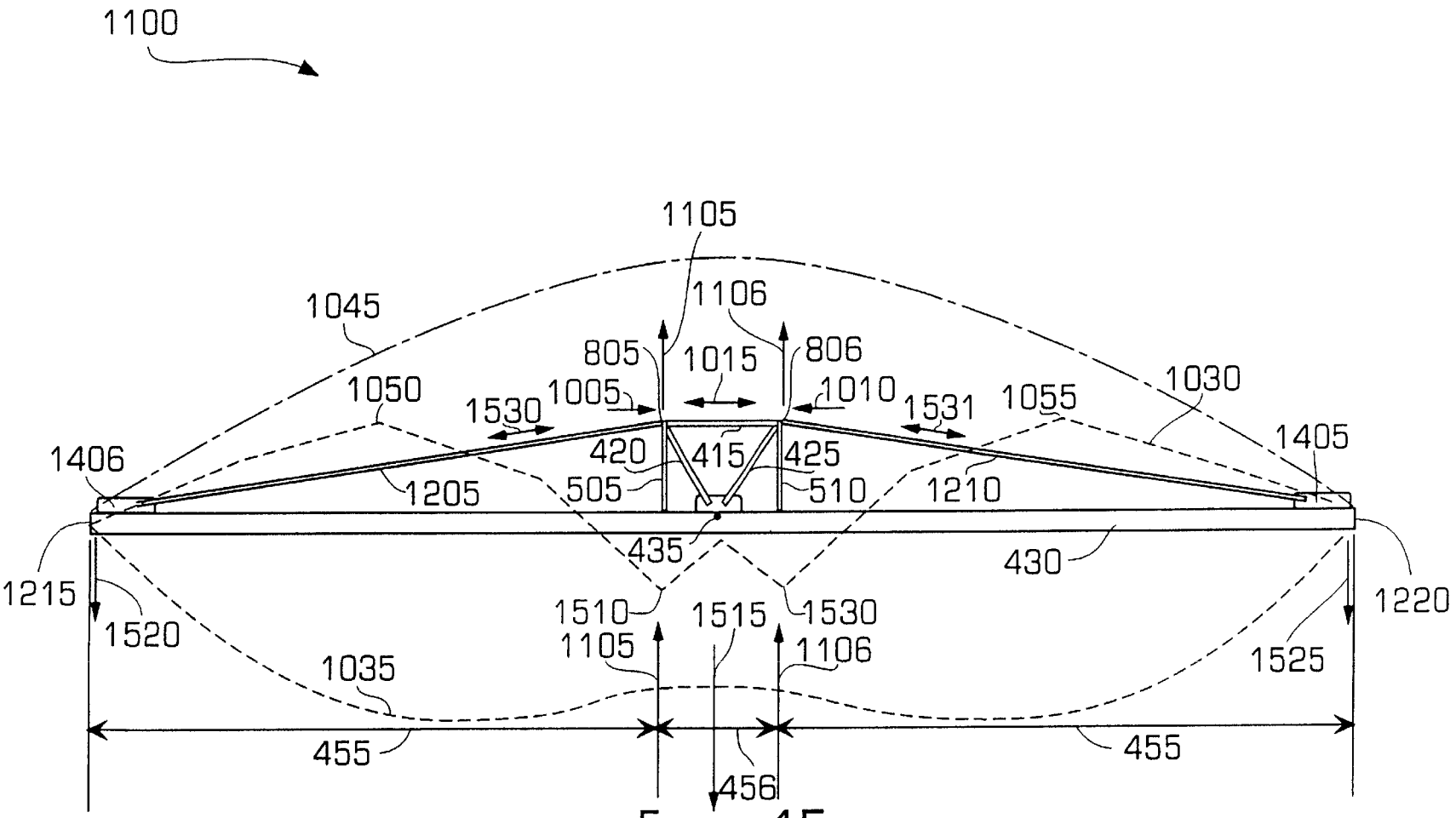
FIG. 15 illustrates how one embodiment of the truss redistributes the maximum bending moment of the girder.

FIG. 15 illustrates how the preferred embodiment of the truss segment 400 works together with the first diagonal truss member 1205, the second diagonal truss member 1210, and the girder 430 to distribute and reduce the maximum bending moment of the girder 430 and reduce the deflection of the girder 430 when a uniform load is applied to the girder 430. As the girder 430 attempts to deflect down under the influence of an applied load, it also rotates away from the horizontal. As a result of this rotation, the second ends of the first and third truss segment members, 505 and 510 respectively, tend to move towards each other as shown by force vectors 1005 and 1010. The fifth truss segment member 415 prevents the movement of the first and third truss segment members, 505 and 510 respectively, thus placing the fifth truss segment member 415 in compression as shown by force vector 1015. As a consequence, the triangles formed by the first and second truss segment members, 505 and 420 respectively, and the third and fourth truss segment members, 510 and 425 respectively, exert a prying force upon the girder 430 which opposes the normal bending of the girder 430 as the girder 430 experiences "beam action". This prying force tends to lift 1020 the girder 430 at a region near the midpoint 435, and push down 1025 on the girder 430 at the first and second locations, 515 and 520 respectively, where the first and third truss segment members, 505 and 510 respectively, are located. As a result of the prying force, the bending moment 1045 which occurs when using conventional bridge girder designs is distributed along the girder 430. The distributed bending moment 1030 is shown in FIG. 10.

At this point, as shown in FIG. 10, the first positive maximum 1050 of the distributed bending moment 1030 occurs substantially at the first location 515 of the first truss segment member 505 and the second positive maximum 1055 of the distributed bending moment 1030 occurs substantially at the second location 520 of the third truss segment member 510.

The addition of the first and second diagonal truss members, 1205 and 1210 respectively, to the truss segment 400 helps to further distribute the bending moment of the girder 430. The first and second diagonal truss members, 1205 and 1210 respectively, normally tend to rotate downward and subtend an arc under the influence of the downward deflection of the beam, however, the fifth truss segment member 415, which is in compression 1015, prevents the first and second diagonal truss members, 1205 and 1210 respectively, from subtending an arc as joints 805 and 806 move downward. Restricting the arc of rotation for diagonal truss members 1205 and 1210 respectively, causes them to shorten in length, conforming to the position between their respective connectors 805 and 806. The shortened length of the diagonal truss members, 1205 and 1210 respectively, causes a compressive stress 1530 to develop in the first diagonal truss member 1205 and a compressive stress 1531 to develop in the second diagonal truss member 1210 consistent with the compressive stress 1015 in the fifth truss segment member 415. When the diagonal truss members 1205 and 1210 are placed in compression, a statical reaction upward 1105 and a statical reaction upward 1106 and perpendicular to the girder 430 is created at connectors 805 and 806 respectively. Furthermore, statical reactions 1520 and 1525 in the downward direction perpendicular to the girder 430 is created at connectors 1406 and 1405 respectively. The upward reactions 1105 and 1106 at connectors 805 and 806 respectively serve to reduce the net load at a region near the midpoint 435 of the girder 430 and causes a further shift of the first and second positive maximum bending moments, 1050 and 1055 respectively, towards the ends of the girder.

As shown in FIG. 15, the first positive maximum bending moment 1050 now occurs between the first end 1215 of the girder and the first truss segment member 505. The second positive maximum bending moment 1055 now occurs between the second end 1220 of the girder and the third truss segment member 510. This distribution of the bending moment and reduction of deflection 1035 also effectively decreases the net maximum bending moment in the 430 girder and as a consequence decreases the net energy requirements of the girder 430. Reducing the energy requirements of the primary girder also reduces the girder 430 cross sectional area, moment of inertia, and material weight of the girder 430 compared to conventional designs which do not utilize the mechanisms described in this invention. Note that the functionality of the truss 1100 ceases to exist when the elements of the truss 1100 no longer exert the prying force at a region near the girder 430 midpoint 435 that tends to flatten out the deflection of a conventional girder at midspan. Furthermore the functionality of the truss 1100 also ceases to exist when the elements of the truss 1100 no longer distribute the bending moment of the girder 430 so that the first positive maximum bending moment 1050 occurs between the first end 1215 of the girder 430 and first truss segment member 505 and the second positive maximum bending moment 1055 occurs between the third truss segment member 510 and the second end 1220 of the girder 430. The prying force at a region near the girder 430 midpoint 435 and the distribution of the maximum bending moment of the girder 430 occurs under the preferred embodiment of the invention where the ratio of the length of the first and third truss segment members, 505 and 510 respectively, to the length 460 of the girder 430 is of the order of 1:11 to 1:17 and the width 456 between the first and third truss segment members, 505 and 510 respectively, is less than or equal to one-third the length 460 of the of the girder 430. The prying force created by the action of the truss 1100 also tends to flatten the girder deflection 1035 even further at a region near the midpoint 435 of the girder 430.

Figure 16:
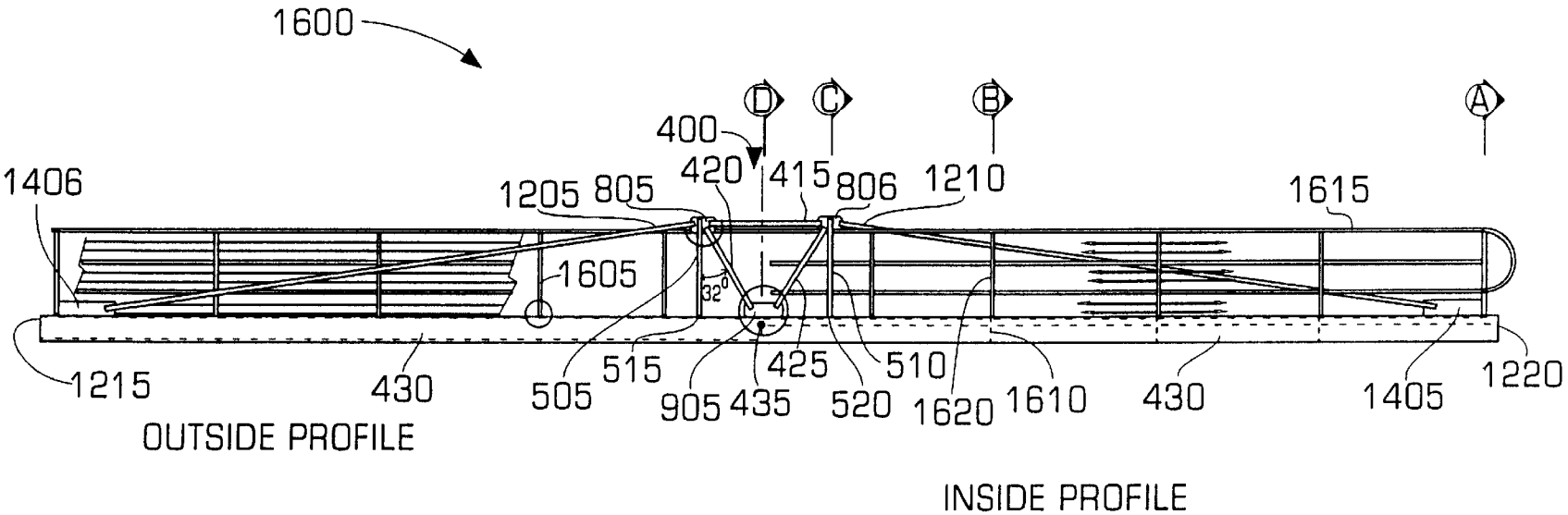
FIG. 16 shows one embodiment of a bridge design encompassing the truss.

FIG. 16 shows a divided profile view of an elevated bridge 1600 encompassing the truss 1100 according to the present invention. The left half of FIG. 16 shows a profile view of the bridge 1600 encompassing the truss 1100 as seen from the outside of the bridge 1600. The right half of FIG. 16 shows a profile view of the bridge 1600 as seen from the inside on the roadway of the bridge 1600 and looking toward the outside of the bridge 1600. The girder 430 has a span between the first end 1215 of the girder 430 and the second end 1220 of the girder 430. The first end of the first truss segment member 505 is attached substantially perpendicular to the girder 430 at a first location 515 near the midpoint 435 region of the girder 430. The first end of the second truss segment member 420 is attached at the midpoint 435 region of the girder 430 and the second end of the second truss segment member 420 is attached to the second end of the first truss segment member 505. The first end of the third truss segment member 510 is attached substantially perpendicular to the girder 430 at a second location 520 near the midpoint 435 region of the girder 430. The first location 515 is located between the second location 520 and the first end 1215 of the girder 430. The first end of the fourth truss segment member 425 is attached at the midpoint 435 region of the girder 430 and the second end of the fourth truss segment member 425 is attached to the second end of the third truss segment member 510. The first end of the fifth truss segment member 415 is connected to the second end of the first truss segment member 505 and the second end of the fifth truss segment member 415 is connected to the second end of the third truss segment member 510.

The first end of the first diagonal truss member 1205 is attached to the second end of the first truss segment member 505 and the second end of the first diagonal truss member 1205 is attached substantially close to the first end 1215 of the girder 430. The first end of the second diagonal truss member 1210 is attached to the second end of the third truss segment member 510 and the second end of the second diagonal truss member 1210 is attached substantially close to the second end 1220 of the girder 430. The first and second diagonal truss members, 1205 and 1210 respectively, are connected to girder 430 at regular intervals by vertical support members 1605. Support members 1610 support a roadway between two girders 430. A railing 1615 (or guard) is supported by support members 1620.

The first truss segment member 505 and the third truss segment member 510 of the truss segment 400 shown here in FIG. 16 are approximately equidistant from the midpoint 435 of the girder 430. The width 456 between the first location 515 of the first truss segment member 505 and the second location 520 of the third truss segment member 510 is of the order of less than or equal to one-third (⅓) the length 460 of the girder. Furthermore, the ratio of the length of the first and third truss segment members, 505 and 510 respectively, to the length 460 of the girder 430 are of the order of 1:11 to 1:17. The angle 470 formed between the first truss segment member 420 and the second truss segment member 505 is approximately thirty-two degrees. Similarly, the angle 465 formed between the third truss segment member 510 and the fourth truss segment member 425 is approximately thirty-two degrees.

Figure 17:
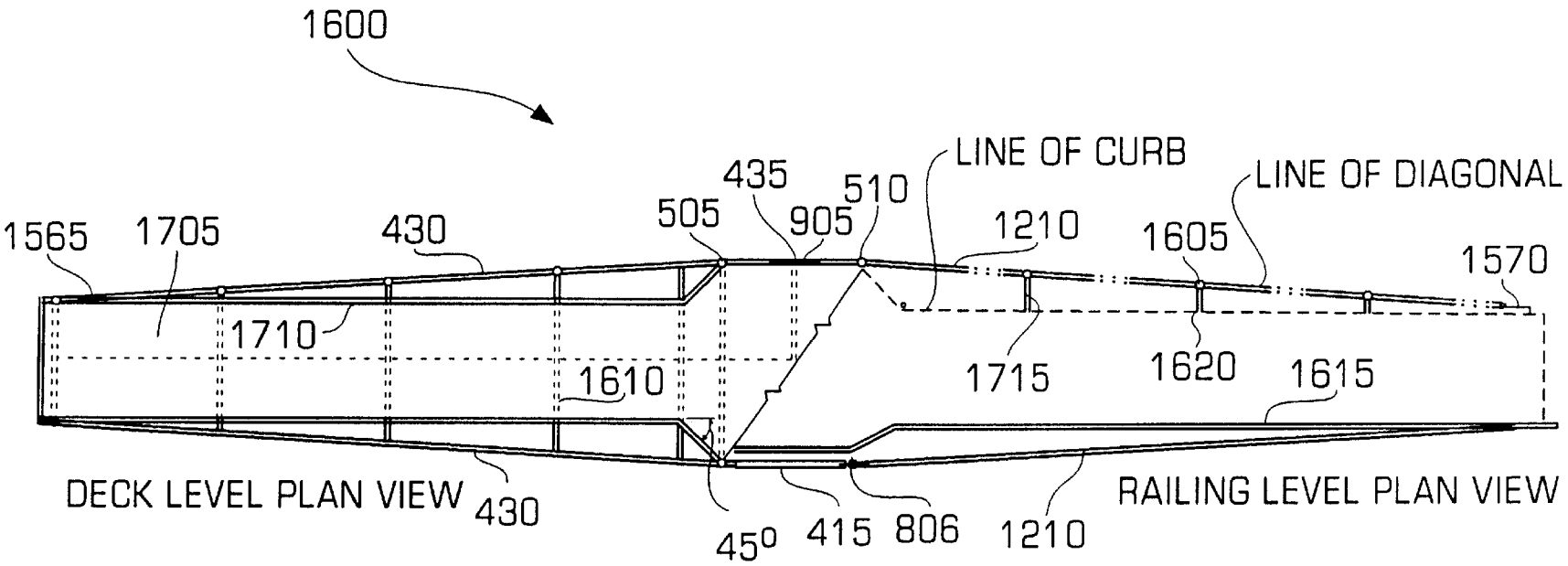
FIG. 17 shows a top view of the bridge design encompassing the truss.

FIG. 17, which is divided into two views, shows a view from above the bridge 1600 and looking down on the bridge 1600 at the supported roadway 1705. The left half of FIG. 17 shows a roadway level view of the bridge 1600. The right half of FIG. 17 shows an overhead view of the support members attached to and above girders 430. The girder 430 diverges out so that the overall breadth of the girder 430 assembly is wider at the midpoint 435 than at the first and second ends, 1215 and 1220 respectively, of the girder 430. The roadway 1705 is supported by support members 1610 which connect the roadway 1705 to the girders 430. A curb 1710 helps to define the sides of the roadway 1705.

The diagonal truss members, 1205 and 1210 respectively, are connected to each girder 430 on either end of the bridge 1600. Note that here in FIG. 17, only diagonal truss member 1210 is shown. The fifth truss segment member 415 connects across the midpoint 435 region of the girder 430 between connectors 805 and 806. Vertical support members 1620 and 1605 are in alignment at regular intervals and are connected together by support member 1715. Support members 505 and 510 rise vertically from the girders 430 near the midpoint 435 region of the girders 430. Connector 905 is shown where it connects the second and fourth truss segment members, 420 and 425 respectively, near the midpoint 435 region of the girder 430.

The truss enhanced bridge girder of the present invention allows a larger load to be carried at the midpoint 435 region of the girder 430 than conventional bridge designs. As shown in FIG. 17, the girders 430 can be angled out away from the bridge centerline so that the center of the bridge 1600 is wider than the ends of the bridge 1600. This increased capacity at the midpoint 435 region of the girder 430 is due to the fact that the bending moment at midpoint 435 region of the girder 430 is substantially reduced and the maximum bending moment is shifted toward the first and second ends, 1215 and 1220 respectively, of the girder 430. This allows a roadway 1705 to be constructed so that it runs straight for a distance, bounded by the curb 1710, and expands at the midpoint 435 region of the bridge 1600 providing an increased roadway 1705 surface for a turnaround, rest area or parking area. This is a significant improvement over conventional bridge designs which cannot sustain the increased load at the midpoint 435 region of the girder 430. A railing 1615 or other type of roadway 1705 boundary can be provided which marks the extent of the roadway 1705. The area between the girders 430 and the roadway curb 1710 or the railing 1615 can be open and not covered by any roadway 1705 or surfacing.

Figure 18:
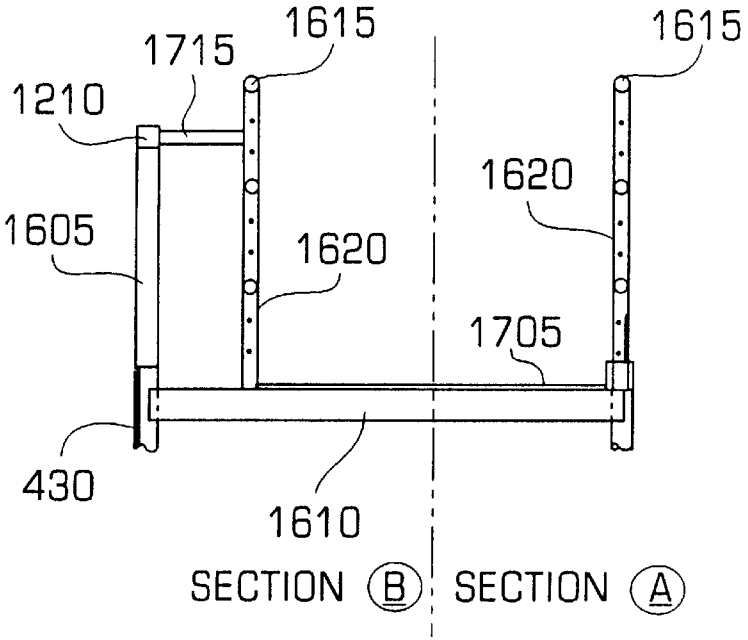
FIG. 18 shows partial sectional end view of a bridge and a partial sectional view at a quarter point of the length of a bridge encompassing the truss.

The right half of FIG. 18 shows a partial sectional view of the bridge 1600 at the second end 1220 of the girder 430 and the left half of FIG. 18 shows a partial sectional view at a quarter point along the length of the bridge 1600. The roadway 1705 is supported between the two girders 430 by support members 1610. Vertical support members 1620 are connected to the railing 1615. The diagonal 1210 is connected to the vertical support members 1605 and to the support member 1715. Support member 1715 connects between both support 1605 and 1620. Support member 1605 is also connected to the girder 430. Support member 1620 is connected to the support member 1610. The support members 1610, 1605, 1715, and 1620 form a rectangular transverse brace which reinforces the diagonal member 1210 against column buckling. The divergent girders 430 provide the lateral dimension needed for the rectangular form of the column brace. The divergent girders 430 allow a rectangular bracing structure to be constructed. This bracing structure is composed of members 1605, 1620, 1715 and the roadway support member 1610 (FIG. 18.) The gap between the roadway and the girder provides the lateral dimension needed for the rectangular form of the bracing structure.

Figure 19:
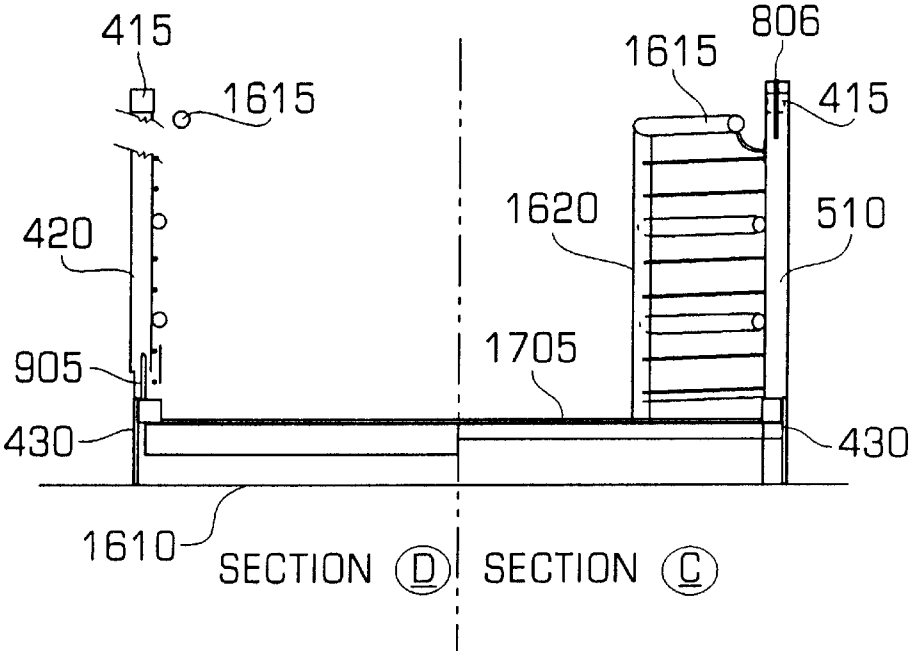
FIG. 19 shows two partial sectional views of the midpoint of a bridge encompassing the truss.

The right half of FIG. 19 shows a partial sectional view at the point where the roadway 1705 widens near the midpoint 435 of the girder 430. The railing 1615 is shown attached to support member 1620 and extending sideways to accommodate the wider roadway 1705. Girder 430 is shown near the midpoint 435 of its span where it is connected to the third truss segment member 510. The fifth truss segment member 415 which connects across the midpoint of the girder 430 connects to the connector 806. The third truss segment member 510 also connects to the connector 806 so that the fifth truss segment member 415 and the third truss segment member 510 are connected to each other through the connector 806. The left half of FIG. 19 shows a partial sectional view at the midpoint 435 region of the bridge 1600. The connector 905 is located at the midpoint 435 region of the girder 430 and connects the girder 430 to the fourth truss segment member 425 and the second truss segment member 420. The railing 1615 extends above the expanded roadway 1705.

Figure 20:
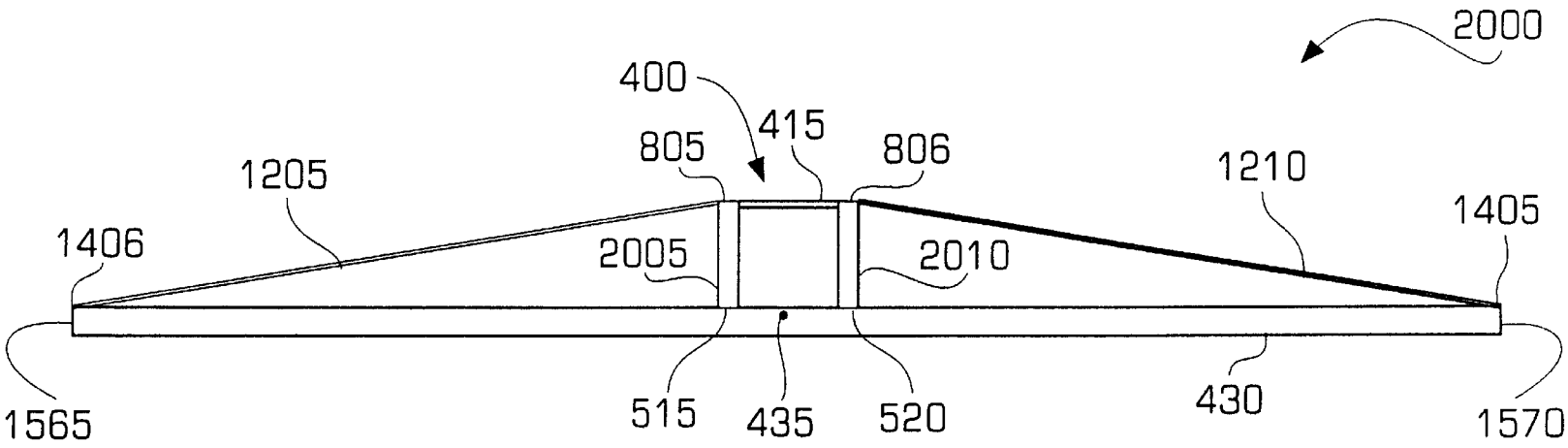
FIG. 20 shows an alternative embodiment of the truss.

FIG. 20 shows a variation of the trussed 1100. In FIG. 20, the first and third truss segment members, 505 and 510 respectively, are replaced by first and second short vertical beams 2005 and 2010. The addition of the first and second short vertical beams 2005 and 2010 eliminates the need for the second and fourth truss segment members, 420 and 425 respectively. The first end of the first beam member 2005 is attached substantially perpendicular to the girder 430 at the first location 515. The first end of the second beam member 2010 is attached substantially perpendicular to the girder 430 at the second location 520. The first end of the fifth truss segment member 415 is attached to the second end of the first beam member 2005 and the second end of the fifth truss segment member is attached to the second end of the second beam member 2010.

The first end of the first diagonal truss member 1205 is attached to the second end of the first beam member 2005 at connector 805. The second end of the first diagonal truss member 1205 is attached substantially close to the first end 1215 of the girder 430 at connector 1406. The first end of the second diagonal truss member 1210 is attached to the second end of the second beam member 2010 at connector 806. The second end of the second diagonal truss member 1210 is attached substantially close to the second end 1220 of the girder 430 at connector 1405. An upward force 1105 is applied to the second end of the first truss segment member 505 and an upward force 1106 is applied to the second end of the third truss segment members 510 to distribute the maximum bending moment of the girder 430 toward the ends of the girder 430.

In this embodiment of the truss enhanced girder, the first and second beam members, 2005 and 2010 respectively, are rigid enough to impose a counter moment in the girder 430. The counter moment developed by beam members 2005 and 2010 is mechanically similar to the prying moment developed by first truss segment member 505, second truss segment member 420, third truss segment member 510 and fourth truss segment member 425 when a horizontal force is applied to joints 805 and 806 (FIG. 10). The counter moment opposes the normal bending of the girder 430 and tends to flatten the girder deflection 1035 at a region near the midpoint 435 of the girder 430. The counter moment is applied to the beam 430 at the first location 515 where beam member 2005 connects to the girder 430 and at the second location 520 where the beam member 2010 connects to the girder 430.

Figure 21:
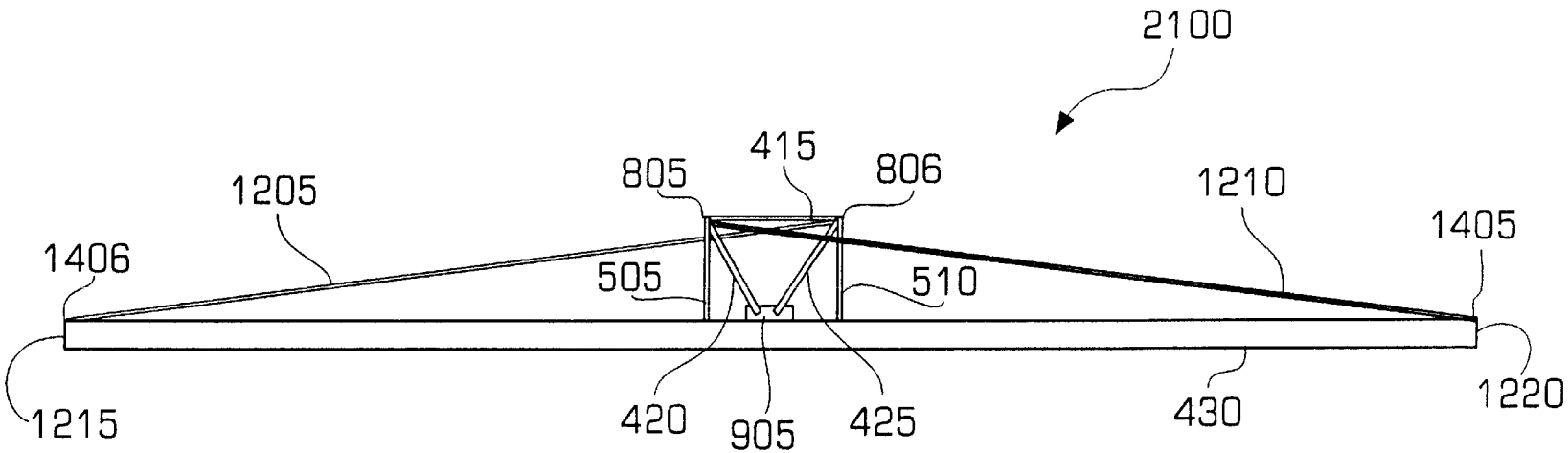
FIG. 21 shows another alternative embodiment of the truss.

FIG. 21 shows a variation of the truss 1100. FIG. 21 is substantially similar to FIG. 7 with the addition of the fifth truss segment member 415 to the truss segment 400. In FIG. 21, the first and second diagonal truss members, 1205 and 1210 respectively, connect to opposing ends of the truss 400 as shown before in FIG. 7 and create opposing forces which act at joints 805 and 806 causing the truss 400 to develop a prying force in the girder. The fifth truss segment member 415 exerts a lateral outward force at the second ends of the first and third truss segment members, 505 and 510, respectively. The first and second diagonal truss members, 1205 and 1210 respectively, also develop a vertical upwards force at joints 805 and 806 respectively, which reduces the net load at a region near the midpoint 435 of the girder 430 and causes a further shift of the maximum bending moment towards the end points 1215 and 1220, of the girder.

In summary, the truss for distributing a maximum bending moment normally occurring at a midpoint region of a girder includes a first truss segment member having first and second ends, a second truss segment member having first and second ends, a third truss segment member having first and second ends, a fourth truss segment member having first and second ends, and a fifth truss segment member having first and second ends. The first end of the first truss segment member is attached substantially perpendicular to the girder at a first location near the midpoint region of the girder. The first end of the second truss segment member is attached at the midpoint region of the girder and the second end of the second truss segment member is attached to the second end of the first truss segment member. The first end of the third truss segment member is attached substantially perpendicular to the girder at a second location near the midpoint region of the girder. The first location is located between the second location and the first end of the girder. The first end of the fourth truss segment member is attached at the midpoint region of the girder and the second end of the fourth truss segment member is attached to the second end of the third truss segment member. The first end of the fifth truss segment member is attached to the second end of the first truss segment member and the second end of the fifth truss segment member is attached to the second end of the third truss segment member. An upward force is applied to the second ends of the first and third truss segment members to distribute the maximum bending moment of the girder toward the ends of the girder. A first positive maximum bending moment of the girder occurs between the first end of the girder and the first location and a second positive maximum bending moment of the girder occurs between a second end of the girder and the second location.

Although the present invention has been described in detail, it should be understood that various changes, substitutions and alterations can be made hereto without departing from the spirit and scope of the invention as described by the appended claims.

What is claimed is:

1. In combination, a girder and a structural segment for distributing a maximum bending moment normally occurring at a midpoint region of the girder under a uniform applied load, the girder having a length and first and second ends, the structural segment comprising:

a first truss segment member having first and second ends, the first end of the first truss segment member being attached to the girder at a first location between the midpoint region and the first end of the girder with the first truss segment member substantially perpendicular to the girder;

a second truss segment member having first and second ends, the first end of the second truss segment member being attached to the girder between the first location and the midpoint region of the girder, the second end of the second truss segment member being attached to the second end of the first truss segment member;

a third truss segment member having first and second ends, the first end of the third truss segment member being attached to the girder at a second location between the midpoint region of the girder and the second end of the girder with the third truss segment member substantially perpendicular to the girder;

a fourth truss segment member having first and second ends, the first end of the fourth truss segment member being attached to the girder between the second location and the midpoint region of the girder, the second end of the fourth truss segment member being attached to the second end of the third truss segment member; and means connected to the first and third truss members for applying an outward lateral force toward the ends of the girder, and a ratio of the length of the first and third truss segment members to the length of the girder having a maximum of 1:11 and a minimum of the order of 1:17.

2. The combination of claim 1, wherein said lateral force applying means comprises a fifth truss segment member attached to the second end of the first truss segment member and to the second end of the third truss segment member.

3. The combination of claim 2 further comprising a second connector for connecting the second ends of the third and fourth truss segment members to an adjacent end of the fifth truss segment member such that said second and adjacent ends do not touch.

4. The combination of claim 2, wherein a width between the first location of the first truss segment member and the second location of the third truss segment member is of the order of less than or equal than one-third the length of the girder.

5. The combination of claim 2 further comprising a first connector for connecting the second ends of the first and second truss segment members to an adjacent end of the fifth truss segment member such that said second and adjacent ends do not touch.

6. The combination of claim 2 further comprising a first diagonal truss member connected to the second end of the first truss segment member and to the girder adjacent the first end of the girder; a second diagonal truss member connected to the second end of the third truss segment member and to the girder adjacent the second end of the girder.

7. The combination of claim 6, wherein a first area defined by the first and second truss segment members and the girder and a second area defined by the first truss segment member, the first diagonal truss member and the girder are unequal.

8. The combination of claim 7, wherein a third area defined by the third and the fourth truss segment members and the girder is substantially equal to the first area, and a fourth area defined by the third truss segment member, the second diagonal truss member and the girder is substantially equal to the second area.

9. The combination of claim 1, wherein a width between the first location of the first truss segment member and the second location of the third truss segment member is of the order of less than or equal to one-third the length of the girder.

10. The combination of claim 1 further comprising a third connector for connecting the first ends of the second and fourth truss segment members to the girder such that said first ends do not touch.

11. The combination of claim 1, wherein the lateral force applying means comprises a first diagonal member connected to the second end of the third truss segment member and to an end region of the girder at the first end of the girder, and a second diagonal member connected to the second end of the first truss segment member and to another end region of the girder at the second end of the girder.

12. The combination of claim 11, wherein a width between the first location of the first truss segment member and the second location of the third truss segment member is of the order of less than or equal to one-third the length of the girder.

13. In combination, a girder and a truss for distributing a maximum bending moment normally occurring at a midpoint region of the girder under a uniform applied load, the girder having a length and first and second ends, the truss comprising:

a first truss segment member having first and second ends, the first end of the first truss segment member being attached to the girder at a first location between the midpoint region and the first end of the girder with the first truss segment member substantially perpendicular to the girder;

a second truss segment member having first and second ends, the first end of the second truss segment member being attached at the midpoint region of the girder, the second end of the second truss segment member being attached to the second end of the first truss segment member;

a third truss segment member having first and second ends, the first end of the third truss segment member being attached to the girder at a second location between the midpoint region of the girder and the second end of the girder with the third truss segment member substantially perpendicular to the girder;

a fourth truss segment member having first and second ends, the first end of the fourth truss segment member being attached at the midpoint region of the girder, the second end of the fourth truss segment member being attached to the second end of the third truss segment member;

a fifth truss segment member attached to the second end of the first truss segment member and to the second end of the third truss segment member;

a first diagonal truss member attached to the second end of the first truss member and to the girder adjacent the first end of the girder;

a second diagonal truss member attached to the second end of the third truss member and to the girder adjacent the second end of the girder;

wherein said first, second, third, fourth, and fifth truss segment members form a panel structure, said truss having only one of said panel structures disposed on said girder; and wherein a width between the first and second locations is less than or equal to one-third the length of the girder.

14. The combination of claim 13, wherein a ratio of the length of the first and third truss segment members to the length of the girder is of the order 1:11 to 1:17.

15. The combination of claim 13, wherein a first area defined by the first and second truss segment members and the girder and a second area defined by the first truss segment member, the first diagonal truss member and the girder are unequal.

16. The combination of claim 15, wherein a third area defined by the third and the forth truss segment members and the girder is substantially equal to the first area, and forth area defined by the the third truss segment member, the second diagonal truss member and the girder is substantially equal to the second area.

17. In combination, a girder and a structural segment, the girder having a length and first and second ends, the structural segment comprising:

a first truss segment member having first and second ends, the first end of the first truss segment member being attached to the girder at a first location between a midpoint region and the first end of the girder with the first truss segment member substantially perpendicular to the girder;

a second truss segment member having first and second ends, the first end of the second truss segment member being attached to the girder at a second location between the midpoint region of the girder and the second end of the girder with the second truss segment member substantially perpendicular to the girder;

a third truss segment member attached to the second end of the first truss segment member and to the second end of the second truss segment member;

first means connected to the first and third truss members for applying an outward lateral force toward the ends of the girder to cause a first positive maximum bending moment of the girder to occur substantially at the first truss segment member and to cause a second positive maximum bending moment of the girder to occur substantially at the third truss segment member;

second means connected to the first and third truss segment members for applying an upward force to the second ends of the first and third truss segment members to cause the first positive maximum bending moment of the girder to occur between the first end of the girder and the first location and to cause the second positive maximum bending moment of the girder to occur between the second end of the girder and the second location; and wherein a width between the first location of the first truss segment member and the second location of the second truss segment member is of the order of less than or equal to one-third the length of the girder, and wherein a ratio of the length of the first and third truss segment members to the length of the girder having a maximum of 1:11 and a minimum of the order of 1:17.

18. The combination of claim 17, wherein said first and second means cause a first bending moment of the girder to occur substantially at the first end of the first truss segment member and a second bending moment of the girder to occur substantially at the first end of the third truss segment member.

19. The combination of claim 17, wherein said first and second means comprises a first diagonal truss member having first and second ends, the first end of the first diagonal truss member attached to the second end of the first truss segment member and the second end of the first diagonal truss member attached adjacent to an end region of the girder at the first end of the girder, and comprise a second diagonal truss member having first and second ends, the first end of the second diagonal truss member attached to the second end of the second truss segment member and the second end of the second diagonal truss member attached to another end region of the girder at the second end of the girder.

* * * * *